US009525217B2

(12) United States Patent
Köllmann et al.

(10) Patent No.: US 9,525,217 B2
(45) Date of Patent: Dec. 20, 2016

(54) SPRING-LOADED CLAMPING ELEMENT AND CONNECTING TERMINAL

(71) Applicant: WAGO Verwaltungsgesellschaft mbH, Minden (DE)

(72) Inventors: Hans-Josef Köllmann, Minden (DE); Wolfgang Gerberding, Oldendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/767,510

(22) PCT Filed: Feb. 12, 2014

(86) PCT No.: PCT/EP2014/052716

§ 371 (c)(1),
(2) Date: Aug. 12, 2015

(87) PCT Pub. No.: WO2014/124959

PCT Pub. Date: Aug. 21, 2014

(65) Prior Publication Data

US 2015/0380837 A1 Dec. 31, 2015

(30) Foreign Application Priority Data

Feb. 13, 2013 (DE) ..... 10 2013 101 408

(51) Int. Cl.
*H01R 4/24* (2006.01)
*H01R 4/48* (2006.01)
*H01R 13/50* (2006.01)

(52) U.S. Cl.
CPC ..... *H01R 4/4818* (2013.01); *H01R 4/4836* (2013.01); *H01R 13/50* (2013.01)

(58) Field of Classification Search
CPC ... H01R 4/4818; H01R 4/4827; H01R 4/4836; H01R 4/4845; H01R 4/48; H01R 4/489; H01R 13/113
(Continued)

(56) References Cited

U.S. PATENT DOCUMENTS 5,454,730 A * 10/1995 Tozuka ..... H01R 4/4818 439/438
5,975,940 A * 11/1999 Hartmann ..... H01R 4/4818 439/441
(Continued)

FOREIGN PATENT DOCUMENTS

CN 102 832 465 A 12/2012
DE 196 54 611 B4 9/2004
(Continued)

OTHER PUBLICATIONS

International Search Report and translation thereof, for corresponding International application No. PCT/EP2014/052716 dated Dec. 5, 2014.
(Continued)

*Primary Examiner* — Xuong Chung Trans
(74) *Attorney, Agent, or Firm* — Renner, Otto, Boisselle & Sklar, LLP

(57) ABSTRACT

A resilient force clamping element (1) is described, said resilient force clamping element having a current rail (2) and a resilient clamping element (3) that comprises a contacting limb (4), a resilient bend (5) that adjoins the contacting limb (4), and a clamping limb (6) that adjoins the resilient bend (5) and comprises a main section (8) that extends from the resilient bend (5), and a clamping section (7) that is arranged in the direction of the current rail (2). The clamping section (7) comprises a clamping edge (11) on a free end of the clamping section (7) so as to form a clamping site between the clamping edge (11) and the current rail (2) for clamping
(Continued)

Figure 1:
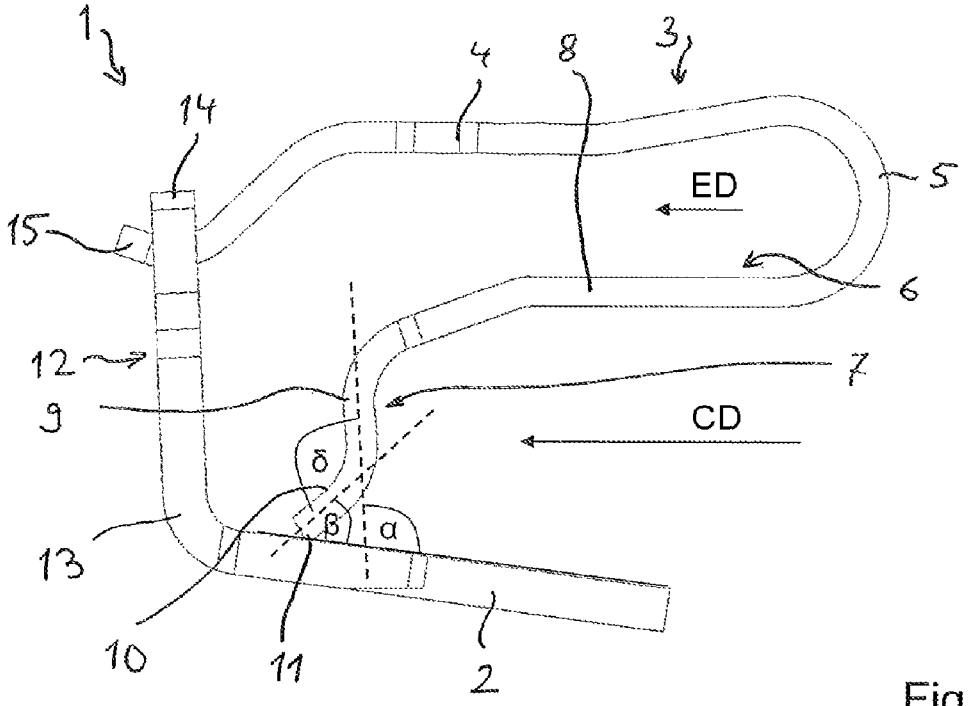

an electrical conductor. The clamping section (7) comprises a first section (9) that is bent from the main section (8) in the direction of the current rail (2), and a second section (10) that adjoins the first section (9) and is bent back in the direction in which the main section (8) extends, said second section comprising the clamping edge (11). In an idle position of the resilient clamping element (3) without an electrical conductor having been inserted, wherein the clamping edge (11) rests on the current rail (2), the first section (9) when viewed in the direction in which the resilient clamping element (3) extends from the resilient bend (5) is at an obtuse angle α with respect to the current rail (2) and the second section (10) is at an acute angle β with respect to the current rail (2).

11 Claims, 3 Drawing Sheets

(58) Field of Classification Search
USPC ..... 439/441, 835, 816
See application file for complete search history.

(56) References Cited

U.S. PATENT DOCUMENTS 7,568,939 B2 * 8/2009 Diekmann ..... H01R 4/4818 439/438
8,851,920 B2 * 10/2014 Wu ..... H01R 4/4827 439/441

FOREIGN PATENT DOCUMENTS

| | | | |
|---|---|---|---|
| DE | 10 2004 045026 | B3 | 2/2006 |
| DE | 20 2005 005369 | U1 | 4/2006 |
| DE | 20 2006 003400 | U1 | 8/2007 |
| DE | 20 2011 050120 | U1 | 10/2012 |
| DE | 10 2011 051536 | A1 | 1/2013 |

OTHER PUBLICATIONS

International Preliminary Report on Patentability, for corresponding International application No. PCT/EP2014/052716 dated Aug. 27, 2015.

* cited by examiner

SPRING-LOADED CLAMPING ELEMENT AND CONNECTING TERMINAL

This application is a national phase of International Application No. PCT/EP2014/052716 filed Feb. 12, 2014.

The invention relates to a resilient force clamping element having a current rail and a resilient clamping element that comprises a contacting limb, a resilient bend that adjoins the contacting limb, and a clamping limb that adjoins the resilient bend and comprises a main section that extends from the resilient bend in the opposite direction to the contacting limb, and a clamping section that is arranged in the direction of the current rail, wherein the clamping section comprises a clamping edge on a free end of the clamping section so as to form a clamping site between the clamping edge and the current rail in order to clamp an electrical conductor.

Furthermore, the invention relates to a connecting clamp having a housing that is embodied from an insulating material and having at least one resilient force clamping connector in the housing that is embodied from an insulating material.

Resilient force clamping elements having leaf springs that are bent in a U-shaped manner are known in many forms. DE 196 54 611 B4 discloses a resilient force clamping connector for single-strand or multi-strand electrical conductors having a current rail piece and a U-shaped leaf spring. The current rail piece comprises a retaining limb and a contacting limb that together form a corner angle. The retaining limb is used to retain the leaf spring and is arranged with its rear face arranged in a transverse manner with respect to the direction in which the conductor is inserted and comprises an opening for guiding through the electrical conductor. The contacting limb directly adjoins in the vertex of the corner angle of the retaining angle and extends from said vertex in the direction in which the conductor is inserted. The leaf spring is formed in the manner of a U-shaped open loop having a rearwards facing resilient bend and two resilient limbs that adjoin said resilient bend, wherein one resilient limb is embodied as a free clamping limb that extends with its free ends into the conductor insertion opening and is arranged at an acute angle with respect to the contacting limb of the current rail piece. The free clamping section is slightly bent with respect to a main section of the contacting limb in the direction towards the current rail so that the main section is at a smaller acute angle than the free clamping section of the clamping limb with respect to the current rail.

DE 10 2004 045 026 B3 discloses an electrical connector or connecting clamp having a clamping limb that is bent from a main section initially approximately parallel to the current rail or rather in the direction that points in the direction in which the contacting limb extends from the resilient bend and therefore is bent back to its free end in the direction of the current rail. The clamping limb of the resilient clamping element therefore comprises a bend that is arranged in the direction of the resilient force of the clamping limb so that as a result of the bend an improved engagement point for the tip of an actuating tool is achieved in order to open the resilient clamping element.

Furthermore, DE 10 2005 048 972 A1 discloses a circuit board connecting clamp having a resilient force clamping connector, wherein a resilient clamping element that is bent in a U-shaped manner comprises a clamping limb that is arranged in the direction of a current rail. This clamping limb is embodied in a slightly bent manner in the free end region.

On this basis, the object of the present invention is to provide an improved resilient force clamping element and an improved connecting clamp, wherein a direct insertion of flexible conductors is hindered.

The object is achieved with the resilient force clamping element having the features of claim 1 and also by virtue of the connecting clamp having the features of claim 11. Advantageous embodiments are described in the dependent claims.

For a resilient force clamping element of the generic type and a connecting clamp having a resilient force clamping element of this type, it is proposed that the clamping section comprises a first section that is bent from the main section in the direction of the current rail and a second section that adjoins the first section and is bent back in the direction in which the main section extends, wherein the second section comprises the clamping edge. In an idle position of the resilient clamping element without an electrical conductor having been inserted, wherein the clamping edge rests on the current rail, the first section when viewed in the direction in which the resilient clamping element extends from the resilient bend is at an obtuse angle with respect to the current rail, whereas the second section is at an acute angle with respect to the current rail.

It is therefore achieved that an electrical conductor is clamped by means of the second section, which is at an acute angle with respect to the current rail, with the aid of the resilient force of the resilient clamping element on the current rail and by means of locking the clamping edge to the electrical conductor the electrical conductor is prevented from being pulled back. This is achieved by means of the acute angle of the second section with respect to the current rail.

However, the first section that is bent in the direction of the current rail is fundamentally more inclined relative to the direction in which the conductor is inserted and with respect to the current rail and is at an obtuse angle with respect to the plane of the region of the current rail, said region adjoining the clamping edge. The first section is arranged in a transverse manner with respect to the direction in which the conductor is inserted and prevents in particular a multi-strand electrical conductor from being directly inserted, said electrical conductor impacting on the first section at an obtuse angle as said electrical conductor is inserted. The clamping site that is formed by means of the clamping edge and the current rail can therefore initially be opened by means of displacing the clamping limb of the resilient clamping element away from the current rail in the direction of the contacting limb. The electrical conductor can then be guided between the current rail and the clamping edge of the resilient clamping element in order to subsequently close the resilient clamping element so that the clamping edge of the resilient clamping element presses on the electrical conductor by means of the resilient force of the resilient clamping element and said electrical conductor presses against the current rail. A surface pressure is therefore exerted by means of the resilient force of the resilient clamping element by way of the clamping edge on the electrical conductor and on an opposite-lying contact edge of the current rail.

Consequently, it is important for the arrangement of the first section that said first section is arranged in a transverse manner with respect to the direction in which the conductor is inserted in order to reliably prevent a multi-strand electrical conductor from being inserted directly in the nominal cross section of the resilient force clamping element, said nominal cross section being designed for said electrical conductor. However, for the arrangement of the second section at an acute angle, it is important to ensure by means of the acute angle that an electrical conductor is reliably clamped and held at the clamping site.

It is preferred that when the first section is in the idle position, it is at an angle of 90 to 120 degrees with respect to the current rail. A with respect to the direction in which the conductor is inserted that is essentially predetermined by means of the direction in which a conductor insertion opening extends in a housing of a connecting clamp, said housing being embodied from an insulating material, the first section can preferably be at an angle with respect to the direction in which the conductor is inserted, said angle being reduced by the tipping angle of the current rail, in other words at an angle of in practice approximately 70 to less than 120 degrees.

In the idle position, the second section is preferably at an angle of approximately 10 to 60 degrees preferably of approximately 30 to 60 degrees with respect to the current rail.

In a preferred embodiment, the inner angle between the first section and the second section of the clamping section amounts to approximately 70 to 170 degrees, preferably approximately 90 to 170 degrees. On the one hand, it is therefore ensured by means of the first section that a multi-strand electrical conductor is prevented from being inserted directly and on the other hand that an electrical conductor is securely clamped in a mechanical and electrical manner.

Furthermore, it is advantageous if the clamping section is narrower than the main section of the resilient clamping element. It is therefore achieved that the resilient clamping element comprises a peripheral region that protrudes laterally with respect to the clamping section and said peripheral region can be used to actuate the resilient clamping element. In addition, as a result of the increased width of the resilient clamping element in the main section, the resilient force of the resilient clamping element is increased in comparison with an embodiment in which the main section is as narrow as the clamping section. Furthermore, it is advantageous if the current rail comprises a contact edge that forms the clamping site with the clamping edge of the resilient clamping element. The clamping force of the resilient clamping element is concentrated on this clamping edge by means of forming a defined contact edge on the current rail and therefore the surface pressure that results from the resilient force of the resilient clamping element is optimized.

In a particularly advantageous embodiment, the current rail comprises a frame element having two lateral connecting pieces that are spaced apart from one another and a transverse connecting piece that connects the lateral connecting pieces one to the other and a conductor feedthrough opening that is limited by means of the lateral connecting pieces and the transverse connecting piece. The frame element extends away from the current rail in the direction of the contacting limb of the resilient clamping element so that the contacting limb can be mounted on the transverse connecting piece. For this purpose, the contacting limb is latched into the transverse connecting piece.

The frame element can be formed as one piece with the current rail or can be a part that is separate from the current rail. It is also feasible that the frame element of the current rail is formed as one piece with the resilient clamping element as an extension of the attachment section and said frame element is latched into the current rail.

With the aid of the frame element, a self-supporting resilient force clamping element is provided, wherein the resilient clamping element is fixed by way of the frame element to the current rail. This self-supporting resilient force clamping element can then be integrated preassembled in this manner in a housing of a connecting clamp, said housing being embodied from an insulating material, and the connecting clamp can subsequently be closed so as to complete the clamping arrangement An advantageous embodiment of a connecting clamp having a housing that is embodied from an insulating material and at least one above described resilient force clamping element is preferably embodied in such a manner that the housing that is embodied from an insulating material comprises at least one conductor insertion opening that extends in the direction in which the conductor is inserted and issues in a conductor receiving chamber between the main section and the current rail, wherein the bent first section of the clamping section is at an angle of approximately 70 to 120 degrees with respect to the direction in which the conductor is inserted in a transverse manner with respect to the conductor feedthrough direction.

Figure 2:
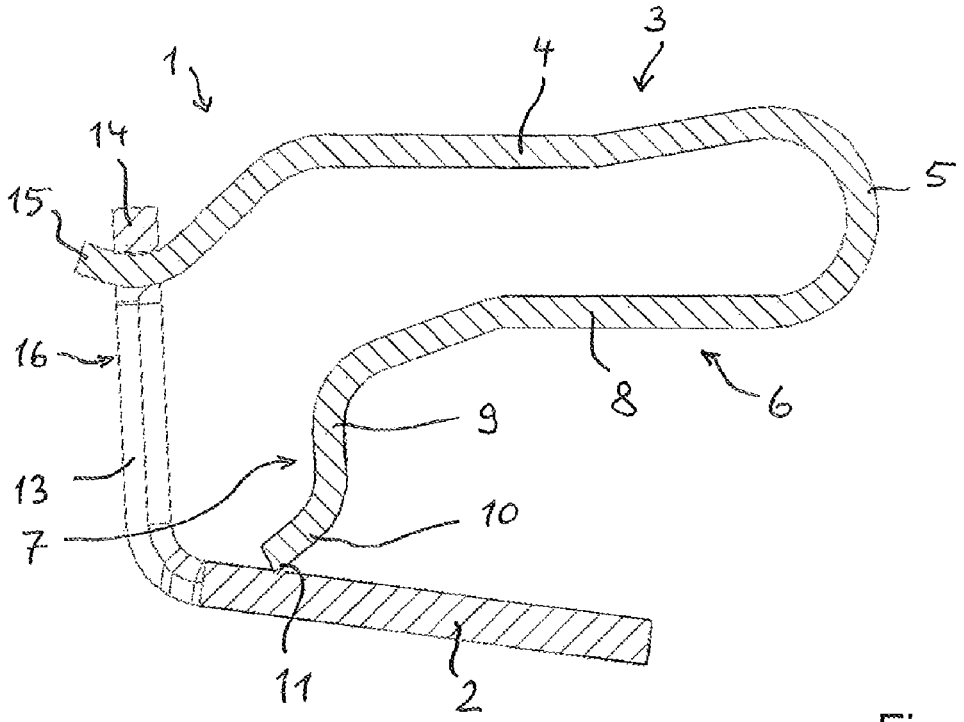
Figure 3:
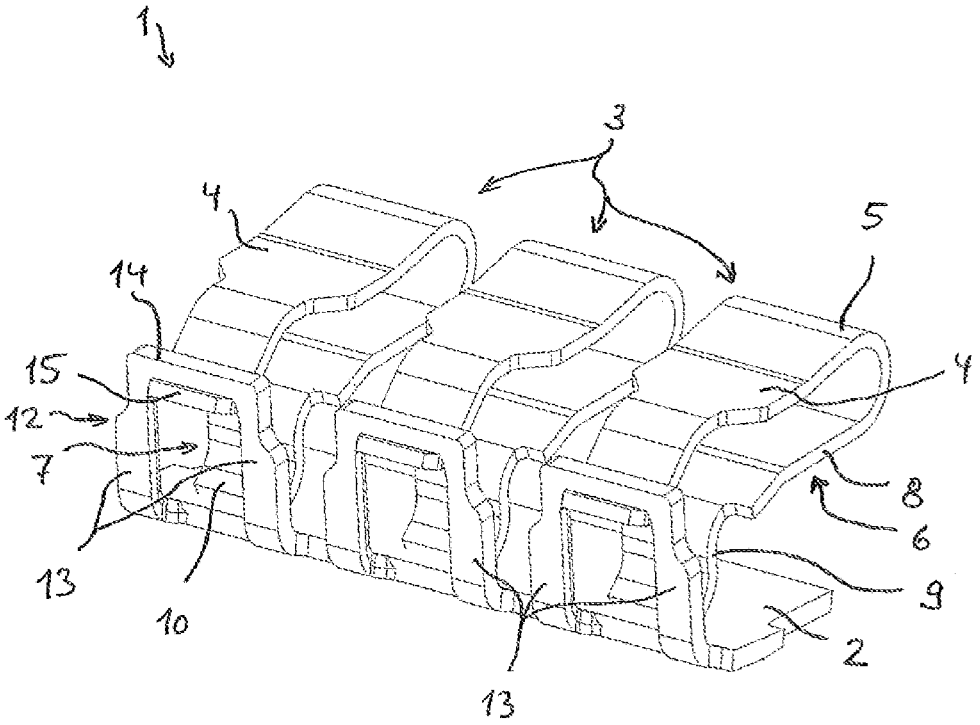
Figure 4:
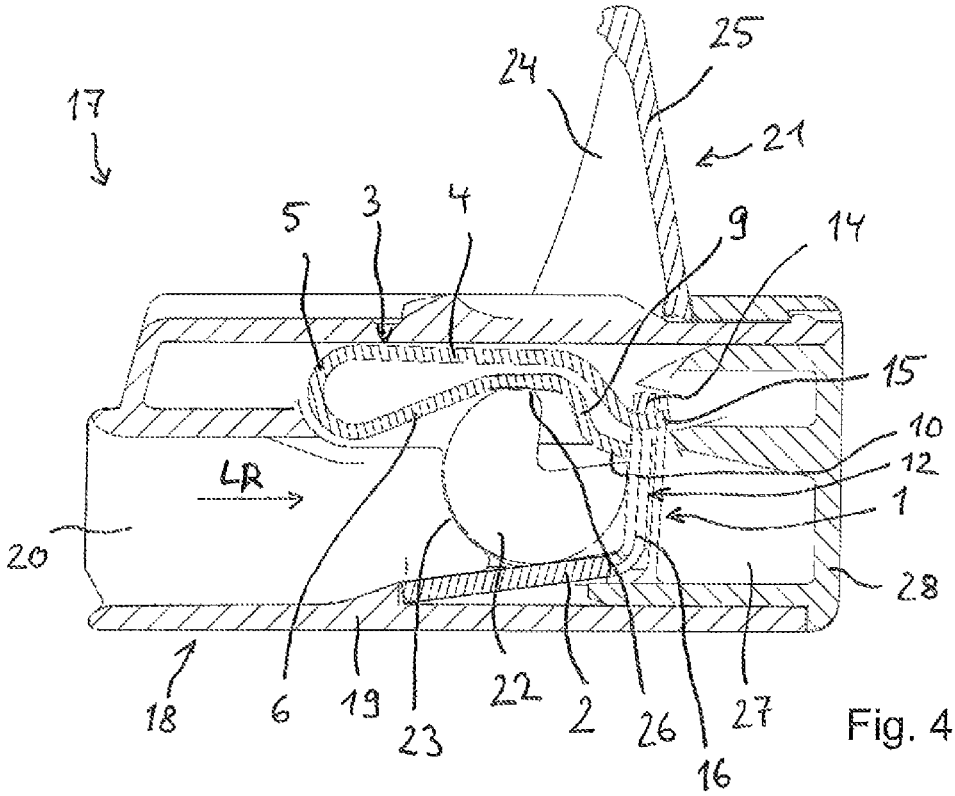
Figure 5:
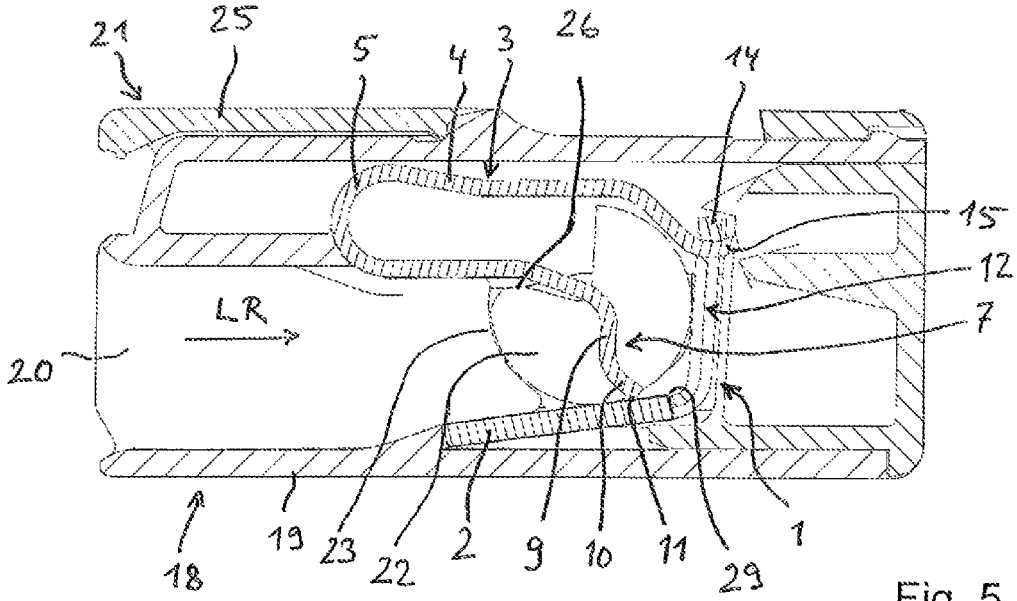

The invention is further explained hereinunder with reference to an exemplary embodiment using the attached drawings. In the drawings:

FIG. 1—illustrates a side view of a resilient force clamping element having a resilient clamping element, a current rail and a frame element;

FIG. 2—illustrates a side sectional view of the resilient force clamping element from FIG. 1;

FIG. 3—illustrates a perspective view of the resilient force clamping element from FIGS. 1 and 2, said resilient force clamping element having three resilient clamping elements that are arranged adjacent to one another;

FIG. 4—illustrates a side sectional view of a connecting clamp having an integrated resilient force clamping element with an actuating lever in the open position;

FIG. 5—illustrates a side sectional view of the connecting clamp in FIG. 4 with an actuating lever in the closed position.

FIG. 1 illustrates a side view of a resilient force clamping element 1 having a current rail 2 and a resilient clamping element 3. The resilient clamping element 3 is bent in a U-shaped manner and comprises a contacting limb 4 and a resilient bend 5 that adjoins said contacting limb and merges into a clamping limb. The clamping limb 6 comprises on its free end region a clamping section 7 that is arranged in the direction of the current rail. This clamping section 7 adjoins a main section 8 of the clamping limb 6, wherein the main section 8 extends from the resilient bend 5. This main section 8 is approximately parallel to the direction in which the conductor is inserted CD (conductor insertion direction) and the direction in which the adjacent contacting limb 4 extends.

It is clear that the clamping section 7 that adjoins the main section 8 comprises a first section 9 that is bent from the main section 8 in the direction of the current rail 2 and a second section 10 that adjoins said first section. The second section 10 comprises on its free end a clamping edge 11.

It is evident that the first section 9 forms essentially an obtuse angle $\alpha$ with respect to the current rail 2, said angle being considerably larger than the angle $\beta$ of the second section 10 with respect to the current rail 2.

The second section 10 is at an acute angle with respect to the current rail 2, so that the angle $\beta$ is <90 degrees. In the illustrated exemplary embodiment, the angle $\beta$ amounts to approximately 50 degrees.

However, the first section 9 is at an obtuse angle $\alpha$ ($\alpha$ 90 degrees) with respect to the current rail and said angle amounts in the illustrated exemplary embodiment to approximately 105 degrees. This leads to the first section 9 being arranged in a transverse manner with respect to the direction in which the conductor is inserted CD and therefore being arranged in a transverse manner in the conductor insertion opening of a housing that is embodied from an insulating material. An inserted electrical conductor impacts therefore at an obtuse angle on the first section 9 so that any automatic opening of the resilient clamping resilient by means of raising the clamping section 7 from the current rail 2 in particular in the case of a multi-strand electrical conductor is prevented or an automatic opening of this type is at least difficult.

The first section 9 is preferably longer than the second section 10.

It is clear that the current rail 2 is slightly inclined in relation to the direction in which the conductor is inserted CD. The term "an obtuse angle α of the first section 9 with respect to the current rail 2" is therefore understood to also mean an angle of approximately 70 to 150 degrees of the first section 9 with respect to the direction in which the conductor is inserted CD.

It is furthermore evident that a section that is bent in the direction of the contacting limb 4 adjoins the main section of the current rail 2 and the clamping section 7 of the resilient clamping element 3 lies on said current rail in the illustrated idle state. This section forms a frame element 12 by means of two lateral connecting pieces 13 that are spaced apart from one another and a transverse connecting piece 14 that connects these lateral connecting pieces 13 on the free end. A conductor feedthrough opening 16 is formed between the lateral connecting pieces 13 and the transverse connecting piece 14 and also the main section of the current rail 2 in order to insert an electrical conductor with its free end from the clamping site further in the direction in which the conductor is inserted CD through the frame element 12.

It is clear that the contacting limb 4 is latched with a bent free end 15 in the frame element 12 in such a manner that the bent free end 15 of the contacting limb 4 engages under the upper transverse edge 14 of the frame element 12. The contacting limb 4 is consequently held on the frame element 12 by means of the force of the resilient clamping element, while the clamping section 7 of the resilient clamping element 3 exerts a force against the opposite-lying current rail 2. The resilient force clamping element 1 is therefore embodied in a self-supporting manner.

FIG. 2 illustrates a side sectional view of the resilient force clamping element 1 from FIG. 1. In FIG. 2, it becomes clearer that a conductor feedthrough opening 16 of the frame element 12 is limited by means of lateral connecting pieces and the upper transverse connecting piece 14 and also the lower main section of the current rail 2. It is also evident that the free bent end 15 of the contacting limb 4 is latched into the upper transverse connecting piece 14.

FIG. 3 illustrates a perspective view of the resilient force clamping elements 1 from FIGS. 1 and 2. In FIG. 3, it becomes clearer that the current rail 2 can extend in a transverse manner with respect to the direction in which a plurality of resilient clamping elements 3 are arranged in a row so that the resilient clamping elements 3 share a common current rail 2. The electrical conductors that are clamped to the individual resilient force clamping connectors 1 can therefore be connected one to the other in an electrically conductive manner by way of the common current rail 2.

It is clear that the first section 9 of the clamping section 7 of the clamping limb 6 of the resilient clamping elements 3 are arranged in a transverse manner with respect to the direction in which the conductor is inserted CD and approximately parallel to the direction in which the frame elements 12 extend. It is however also clear that following on therefrom a second section 10 that is bent back in comparison to the main section 8 of the clamping limb 6 adjoins this first section 9.

Furthermore, it is evident that the resilient clamping elements 3 in each case are arranged spaced apart from one another and in each case are latched into an associated frame element 12. The frame elements 12 are spaced apart from one another so that an intermediate space is provided between adjacent lateral connecting pieces 13 of the adjacent frame elements 12. Said intermediate space can be used for receiving sections of an actuating lever [not illustrated] and/or a housing intermediate wall.

FIG. 4 illustrates a side view of an embodiment of a connecting clamp 17 having a housing that is embodied from an insulating material 18 in which the above described resilient force clamping element 1 is integrated. The housing that is embodied from an insulating material 18 is embodied in a two-part manner and comprises a housing part 19 that is embodied from an insulating material, wherein a conductor insertion opening 20 is integrated on the front face. The conductor insertion opening 20 extends in a direction in which the conductor is inserted CD. Furthermore, an actuating lever 21 is integrated in the housing that is embodied from an insulating material 18. This actuating lever 21 is mounted with a segment-shaped bearing section 22 with the aid of a segment-shaped bearing contour 23 of the housing that is embodied from an insulating material 18, said segment-shaped bearing contour being tailored to suit said segment-shaped bearing section. The bearing section 22 is located in the width direction at least in part laterally offset adjacent to the resilient force clamping element 1 and in the height direction in a space between the plane of the current rail 2 and the plane of the contacting limb 4 of the resilient clamping element 3. The actuating lever 21 is embodied as a U-shaped actuating lever and comprises two side wall sections 24 that are spaced from one another and extend in a tapered manner from the bearing region 22 to the free end. In the region of the free end, the lateral wall sections 24 are connected one to the other by way of an engagement plate 25 that extends in a transverse manner.

The free space that is formed between the side wall sections 24 and the engagement plate 25 can then be used to receive the outer wall of the housing that is embodied from an insulating material 18 and in part also the resilient force clamping element 1 that lies below said outer wall in order to provide in this manner a compactly constructed connecting clamp 17. It is clear that the bearing region 22 comprises an actuating contour 26 that is in engagement with the clamping limb 6 in the illustrated opened state of the actuating lever 21. For this purpose, a lateral peripheral region of the clamping limb 6 lies on the actuating contour 26 so that the second section 10 of the clamping limb 6 is displaced against the clamping force of the resilient clamping element 3 away from the current rail 2 in the direction of the contacting limb 4. The clamping site is therefore opened for an electrical conductor that is to be connected and an electrical conductor can be guided with its free end, which has been stripped of insulation, in the direction in which the conductor is inserted CD through the conductor insertion opening 20. The free end of an electrical conductor (not illustrated) then issues into a conductor receiving chamber 27 that lies downstream of the frame element 12 when viewed in the direction in which the conductor is inserted CD.

It is furthermore evident that the insulating housing 18 is closed with the aid of a cover 28 after installing the actuating lever 21 and the resilient force clamping element 1, said cover being latched on its rear side, in other words the side lying opposite the conductor insertion opening 20, by the housing part 19.

FIG. 5 illustrates a side view of the connecting clamp 17 from FIG. 4 in the case of a closed actuating lever 21. It is clear that henceforth the actuating contour 26 no longer acts upon the clamping limb 6 of the resilient clamping element 3 so that that clamping edge 11 of the clamping limb 6 sits on the current rail 2. For the case where an electrical conductor has been clamped, said electrical conductor would then be located between the clamping edge 11 and a contact edge 29 of the current rail 2 so that the clamping edge 11 and the contact edge 29 form a clamping site. An electrical conductor would then be securely clamped at the clamping site with the aid of the force of the resilient clamping element 3 and also would be mechanically secured against being pulled out by means of the first section 10 that is at an acute angle with respect to the current rail 2 and the direction in which the conductor is inserted CD and the clamped electrical conductor.

The invention claimed is:

1. A resilient force clamping element, comprising:

a current rail; and a resilient clamping element that comprises a contacting limb, a resilient bend that adjoins the contacting limb, and a clamping limb that adjoins the resilient bend, the clamping limb comprising a main section that extends away from the resilient bend, and a clamping section that is arranged in the direction of the current rail, the clamping section comprising a clamping edge on a free end of the clamping section so as to form a clamping site between the clamping edge and the current rail for clamping an electrical conductor, a first section that is bent from the main section in the direction of the current rail, a second section that adjoins the first section and is bent back in the direction in which the main section extends, said second section comprising the clamping edge, wherein the first section is at an obtuse angle $\alpha$ greater than 90 degrees with respect to the current rail when viewed in the direction in which the resilient clamping element extends from the resilient bend and the second section is at an acute angle $\beta$ less than 90 degrees with respect to the current rail in an idle position of the resilient clamping element without an electrical conductor having been inserted in which idle position the clamping edge rests on the current rail.

2. The resilient force clamping element as claimed in claim 1, wherein in the idle position the first section is at an angle $\alpha$ of 90 to 120 degrees with respect to the current rail.

3. The resilient force clamping element as claimed in claim 1, wherein in the idle position the second section is at an angle $\beta$ of 10 to 60 degrees with respect to the current rail.

4. The resilient force clamping element as claimed in claim 1, wherein the inner angle ($\delta$) between the first section and second section of the clamping section amounts to 70 to 170 degrees.

5. The resilient force clamping element as claimed in claim 1, wherein the clamping section is narrower than the main section.

6. The resilient force clamping element as claimed in claim 1, wherein the current rail comprises a contact edge that together with the clamping edge of the resilient clamping element forms the clamping site.

7. The resilient force clamping element as claimed in claim 6, wherein in the idle position the clamping edge of the resilient clamping element lies upstream of the contact edge when viewed in the direction in which the resilient clamping element extends from the resilient bend.

8. The resilient force clamping element as claimed in claim 1, wherein the current rail comprises a frame element having two lateral connecting pieces that are spaced apart from one another and a transverse connecting piece that connects the lateral connecting pieces one to the other and a conductor feedthrough opening that is limited by means of the lateral connecting pieces and the transverse connecting piece, wherein the frame element extends away from the current rail in the direction of the contacting limb of the resilient clamping element and the contacting limb is mounted on the transverse connecting piece.

9. The resilient force clamping element as claimed in claim 8, wherein the frame element is formed as one piece with the current rail or is a part that is separate from the current rail.

10. A connecting clamp having a housing that is embodied from an insulating material and at least one resilient force clamping element as claimed in claim 1 in the housing that is embodied from an insulating material.

11. The connecting clamp as claimed in claim 10, wherein the housing that is embodied from an insulating material comprises at least one conductor insertion opening that extends in a direction in which the conductor is inserted and said conductor insertion opening issues in a conductor receiving chamber between the main section and the current rail, wherein the bent first section of the clamping section is at an angle of 70 to 120 degrees with respect to the direction in which the conductor is inserted in a transverse manner with respect to the direction in which the conductor is inserted.

* * * * *